US006205735B1

(12) United States Patent
Witcher

(10) Patent No.: US 6,205,735 B1
(45) Date of Patent: Mar. 27, 2001

(54) TWO UNIT DRY STACK MASONRY WALL SYSTEM

(76) Inventor: Steve D. Witcher, P.O. Box 750545, Petaluma, CA (US) 94952

( * ) Notice: Subject to any disclaimer, the term of this patent is extended or adjusted under 35 U.S.C. 154(b) by 0 days.

(21) Appl. No.: 09/307,267

(22) Filed: May 6, 1999

Related U.S. Application Data

(60) Provisional application No. 60/084,557, filed on May 6, 1998.

(51) Int. Cl.[7] ..... E02D 29/02; E04B 5/04

(52) U.S. Cl. ..... 52/604; 52/421; 52/439; 52/574; 52/592.1; 52/596; 52/607; 52/608

(58) Field of Search ..... 52/245, 439, 421, 52/592.6, 592.1, 604, 608, 607, 574

(56) References Cited

U.S. PATENT DOCUMENTS

| | | | | |
|---|---|---|---|---|
| 2,290,369 | * | 7/1942 | Fleischmann | 52/574 |
| 3,557,505 | * | 1/1971 | Kaul | 52/608 X |
| 5,315,802 | * | 5/1994 | Hart | 52/608 X |
| 5,337,527 | * | 8/1994 | Wagenaar | 52/604 X |
| 5,941,042 | * | 8/1999 | Dueck | 52/604 |
| 5,951,210 | * | 9/1999 | Maguire et al. | 52/604 X |

OTHER PUBLICATIONS

Pieter VanderWerf, Mortarless Block Systems, Feb. 1999, Masonry Construction, p. No. 20–24.

* cited by examiner

*Primary Examiner*—Christopher T. Kent
(74) *Attorney, Agent, or Firm*—Johnson & StainbrookLL; Craig M. Stainbrook; Larry D. Johnson

(57) ABSTRACT

A mason wall cementitious building block system comprising two lightweight dry-stackable block units and methods of using such units, including a wall unit and a corner/end unit, connected one to another in an interlocking fashion by means of male posts and female sockets, and variants on each of said units for capping the uppermost course of an assembled wall. The male posts angle rearwardly to define partial apertures, such that adjoining blocks define an aperture which extends vertically between the adjoined blocks for placement of vertical reinforcement, electrical and plumbing chase, and for the introduction of mortar or cement. The top surface defines a recessed cavity for placement of rebar when stacked. The corner/end unit of the present invention interconnects with wall units also by means of posts and sockets and may function as either an end or a corner, requiring only the removal of a small portion of the block at prescored cut lines to alter functions.

The wall cap and corner and end caps interconnect with staggered end headers and include partial adjoining apertures to continue vertical apertures formed by lower courses. Methods of assembling walls from the blocks are disclosed.

8 Claims, 10 Drawing Sheets

TWO UNIT DRY STACK MASONRY WALL SYSTEM

This application claims benefit of Provisional application Ser. No. 60/084,557, filed May 6, 1998.

BACKGROUND OF THE INVENTION

1. Field of the Invention

The present invention relates to unit-shaped masonry blocks, and more specifically to dry-stackable masonry unit configurations and methods of erecting dry-stackable masonry unit structures.

2. Description of the Prior Art

Masonry construction blocks and methods for constructing various kinds of brick or block walls are well known in the art. Because of the difficulty and high cost of constructing walls of quarried stone or block, cast cementitious blocks long ago replaced quarried stone as a preferred material in many applications.

Cast blocks typically have a uniform size and shape, include at least one cavity, and frequently permit physical interlocking, either vertically or horizontally, with integrally formed or independent connection means. Such interlocking designs facilitate rapid assembly and proper alignment during fabrication. They also permit assembly without mortar, so that some designs of cast blocks may be employed for temporary walls that can be easily disassembled.

Walls constructed of cast blocks may rely exclusively on the mass of the blocks to maintain alignment and stability. However, mortarless cementitious cast block walls intended for permanent use usually require additional stability. Accordingly, many designs permit mortar or reinforced concrete to be poured or injected into and to fill gaps and aligned vertical and horizontal openings in the blocks.

However, along with their advantages, the known cast blocks also have many disadvantages, including: difficulty in converting the wall units into end or corner units; lateral instability; vulnerability of exposed mortar to chemical or environmental degradation; expansion and contraction of mortar, causing cracking and separation of blocks; difficulty in constructing curved configurations; and vulnerability of broad flat surfaces to defacement and graffiti.

SUMMARY OF THE INVENTION

The present invention is a mason wall cementitious building block system comprising two lightweight dry-stackable block units and methods of using such units. The blocks include a wall unit and a corner/end unit, and corresponding variations on each to function as cap units. Adjoining wall units and corner/end units connected one to another in an interlocking fashion. Caps for each of these units interconnect with adjoining caps via ends of staggered lengths. The unit shapes, the methods of assembling walls of such units, and the walls constructed of such units, overcome the limitations of the prior art.

The wall unit of the present invention comprises a front face, a rear face, an upper face, a lower face, two sides, two male posts projecting from said sides, and two female sockets integrally formed in said sides. In a preferred embodiment, two holes extend vertically through the block for engagement with raised stops on blocks of inverted position stacked either below or above. The male posts angle back from the front face towards the rear face and terminate in a rounded enlarged head for interconnection with the female socket of an adjoining block. Each rearwardly angled male post defines a partial aperture at the side of the block, such that interconnected adjoining blocks in an assembled wall define an aperture which extends vertically between the adjoined blocks for placement of vertical reinforcement rebar, the introduction of mortar or cement, and plumbing and electrical chase, as needed. The top face defines a shallow recess located in approximately the middle of the block and running the length of the block essentially parallel to the front and rear faces.

The corner/end unit of the present invention comprises an end face, one male post, one defined female socket, and a potential female socket defined by an interior cylindrical aperture extending vertically through the block. This unit may function as either an end or a corner, requiring only the removal of a small portion of the block at prescored cut lines for use as a corner.

The wall cap unit comprises outer faces, two sides with a short projection extending from and a short recess extending into opposite sides of partial arcuate apertures at each side, a bottom surface, and a recess extending into the top bed face and running along its entire length generally parallel to the outer faces. The upper portion of the outer face is decoratively beveled. Corner caps have the same structure as wall caps, but with a right angle introduced at the longitudinal midpoint. The end cap unit is essentially a truncated wall cap unit with a single partial aperture, an end face, and a recess extending into the top bed face that terminates short of the interior border of the end face.

A method of erecting structures comprised of the above-described units comprising the steps of:

1. Forming a poured-in-place concrete footing with embedded vertical reinforcement;

2. Stacking a plurality of courses of block as described above in running bond, stepped, or stacked bond layouts with the male posts of blocks interconnected with the female sockets of adjoining blocks to align and fix the blocks in position and to define a vertical aperture between adjoining blocks for placement of the vertical reinforcement and selected electrical and plumbing chase;

4. Laying horizontal rebar in the aperture defined by one course overlying another;

5. Placing a post tension clamp over the vertical rebar until it nests on horizontal rebar and tightening the clamp to cut into vertical rebars;

6. In the case of permanent walls, pouring mortar or concrete into at least some of the vertical apertures to flow through said apertures and into horizontal apertures to form a continuous joint between adjoining blocks, leaving the front and rear faces exposed.

DETAILED DESCRIPTION OF A PREFERRED EMBODIMENT

The present invention comprises two primary cast block units for constructing a dry-stackable masonry wall, and variants on said units for capping the uppermost course of an assembled wall. The primary units include a wall block unit and a corner/end block unit, and the capping units include a wall cap, corner cap, and an end cap. For simplicity the same numerals shall be used herein to refer to functionally identical elements in each of the various units.

Figure 1:
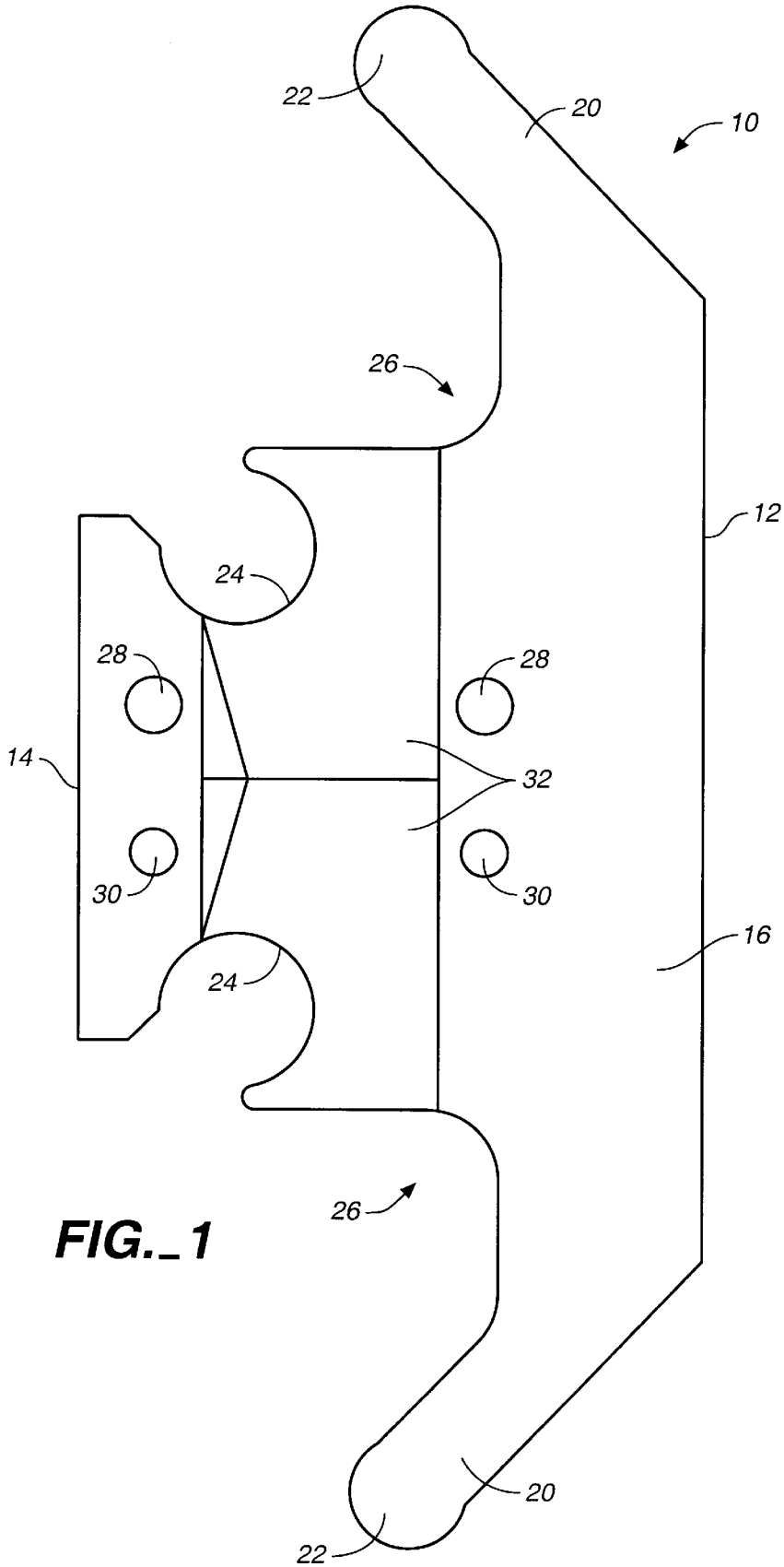
FIG. 1 is a top view of a first embodiment of a dry-stackable cast block wall unit according to the present invention.
Figure 2:
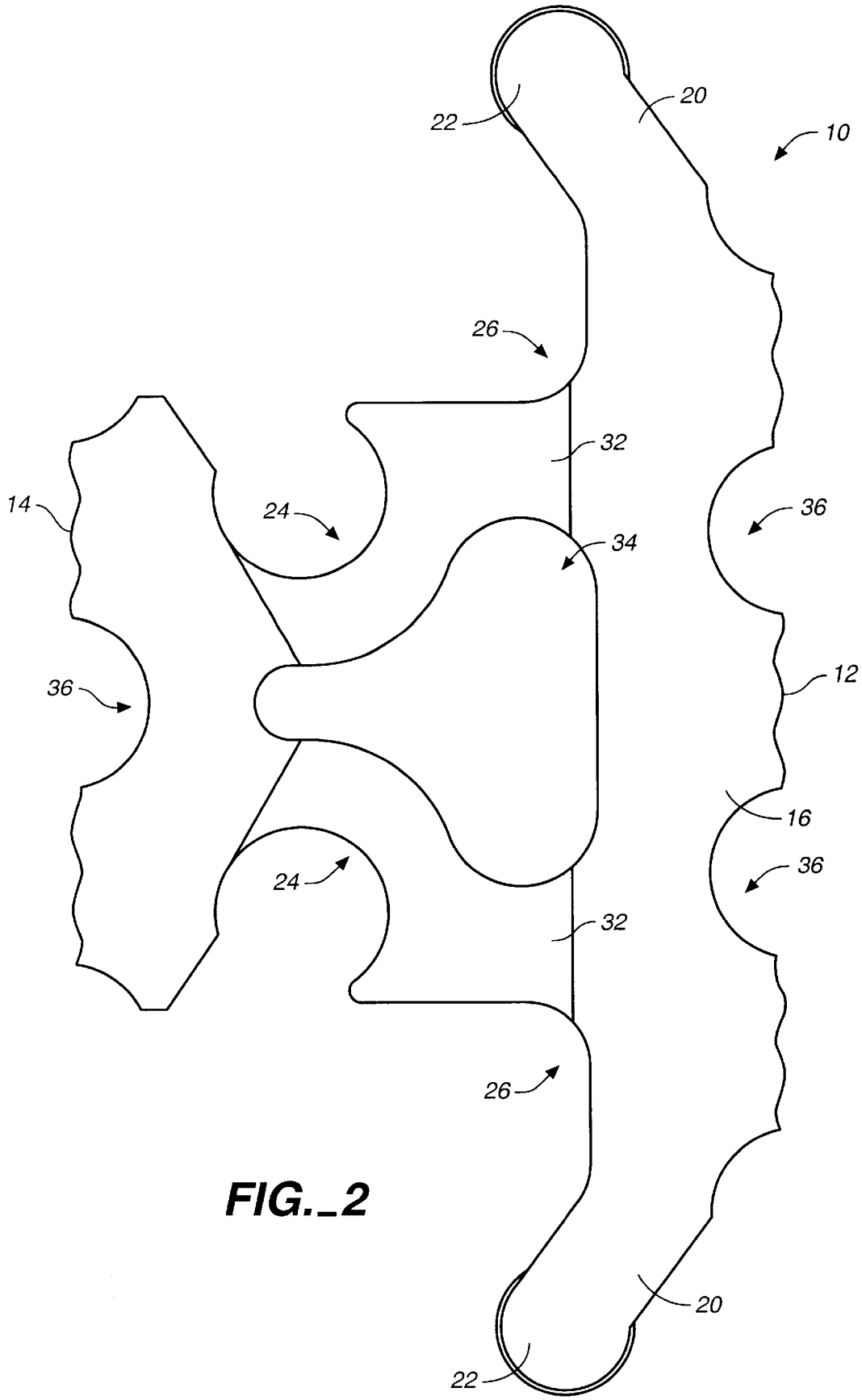
FIG. 2 is a top view of an alternative embodiment of a dry-stackable cast block wall unit, illustrating a fluted, split face design.
Figure 3:
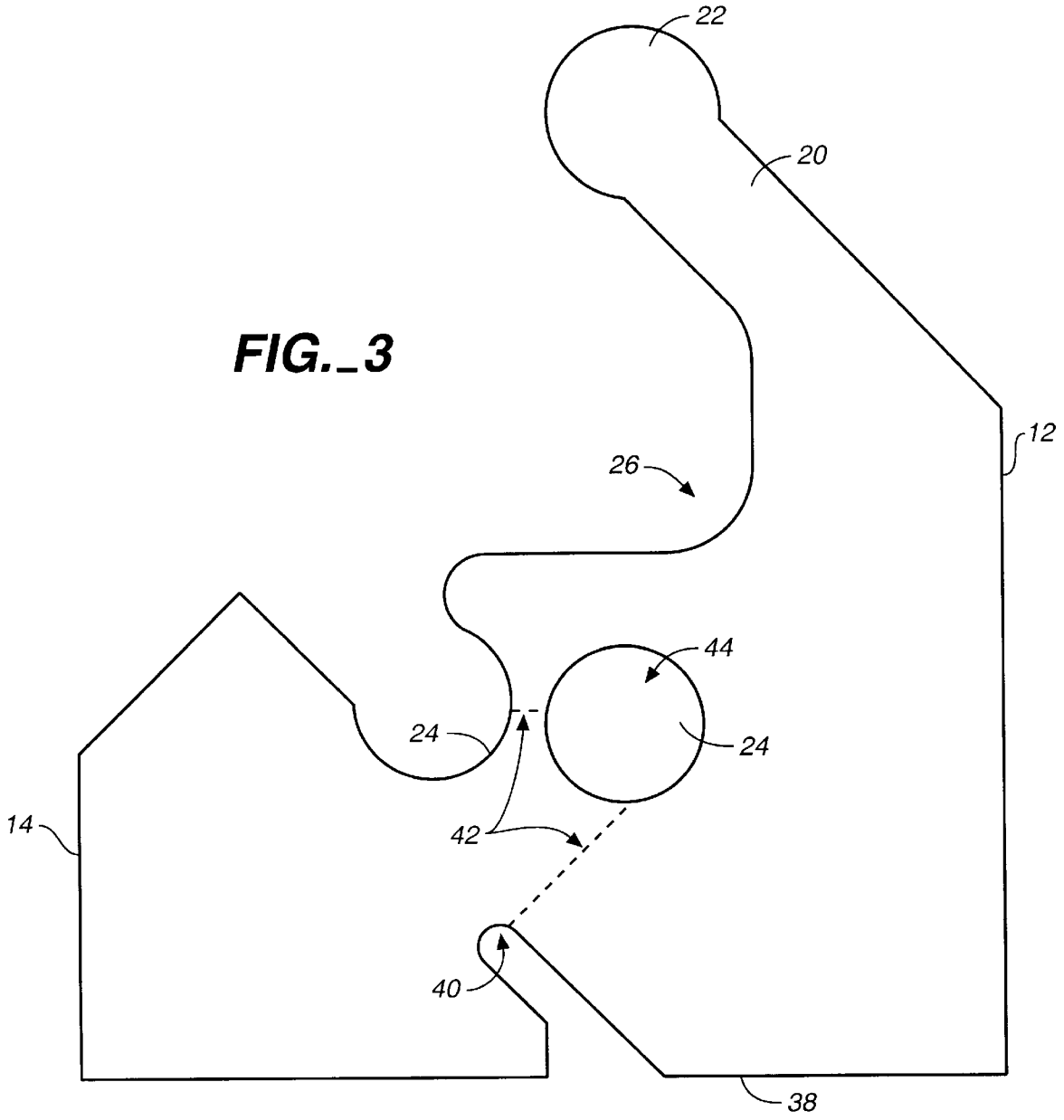
FIG. 3 is a top view of a dry stackable cast block corner/end unit according to the present invention.
Figure 4:
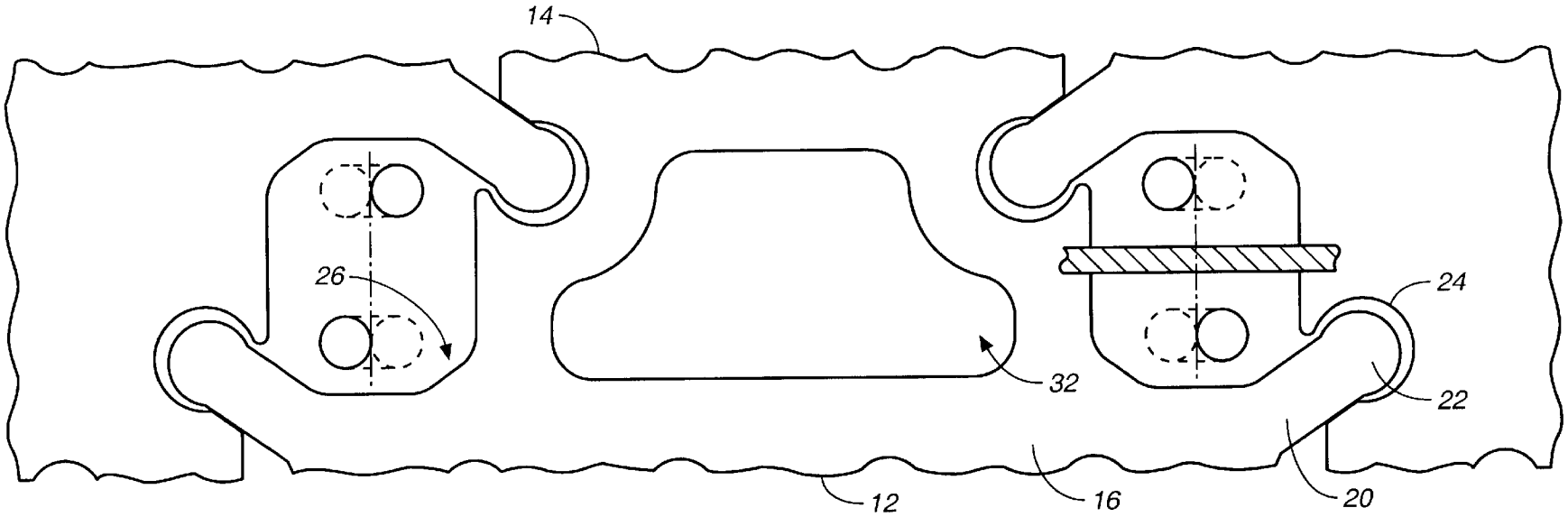
FIG. 4 is a top view of yet another alternative embodiment of a dry-stackable cast block wall unit, illustrating a fluted split face design especially well-suited for sound walls in a stacked bond layout with half height alternating starter course interlocks course to course.

The drawings show six embodiments of the masonry units of the present invention. FIGS. 1, 2 and 4 illustrate embodiments of the wall unit of the invention. FIG. 3 illustrates the corner/end unit of the present invention. FIGS. 12–18 illustrate the wall cap, corner cap, and end cap of the present invention. FIGS. 5–11 and 18–20 show various layouts for constructing dry-stackable masonry walls of the invention.

The masonry units of the present invention may be composed of any number of suitable materials, including various polymers, although the preferred materials are cementitious.

1. Wall Unit

Figure 6:
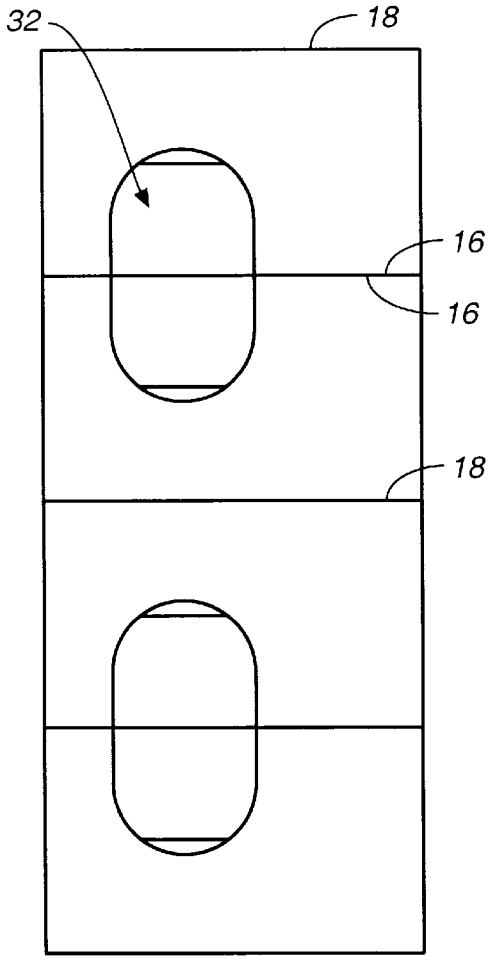
FIG. 6 is a side view of a cross-section stacked bond layout, not showing rebar layout.
Figure 7:
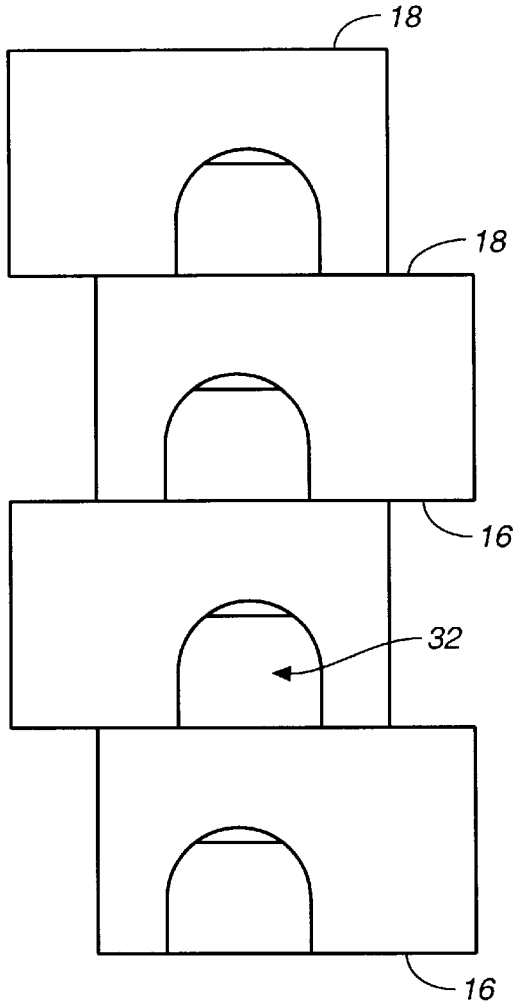
FIG. 7 is an end view of a running bond course, not showing rebar layout.

FIG. 1 is a top view of a first embodiment of the dry-stackable cast masonry wall unit according to the present invention, and is generally illustrated by reference 10. The wall unit according to this first preferred embodiment comprises a front face 12, a rear face 14, an upper face 16, two male posts 20, and two female sockets 24. A lower face 18 (not shown in FIG. 1), is shown in FIGS. 6 and 7 in two end views of stacked wall units. In the first embodiment, two small diameter holes 28 extend vertically through the block for engagement with raised stops 30 on blocks of reversed position stacked either below or above, and thus function to facilitate mating of stacked blocks and to secure the blocks in place when positioned.

Figure 5:
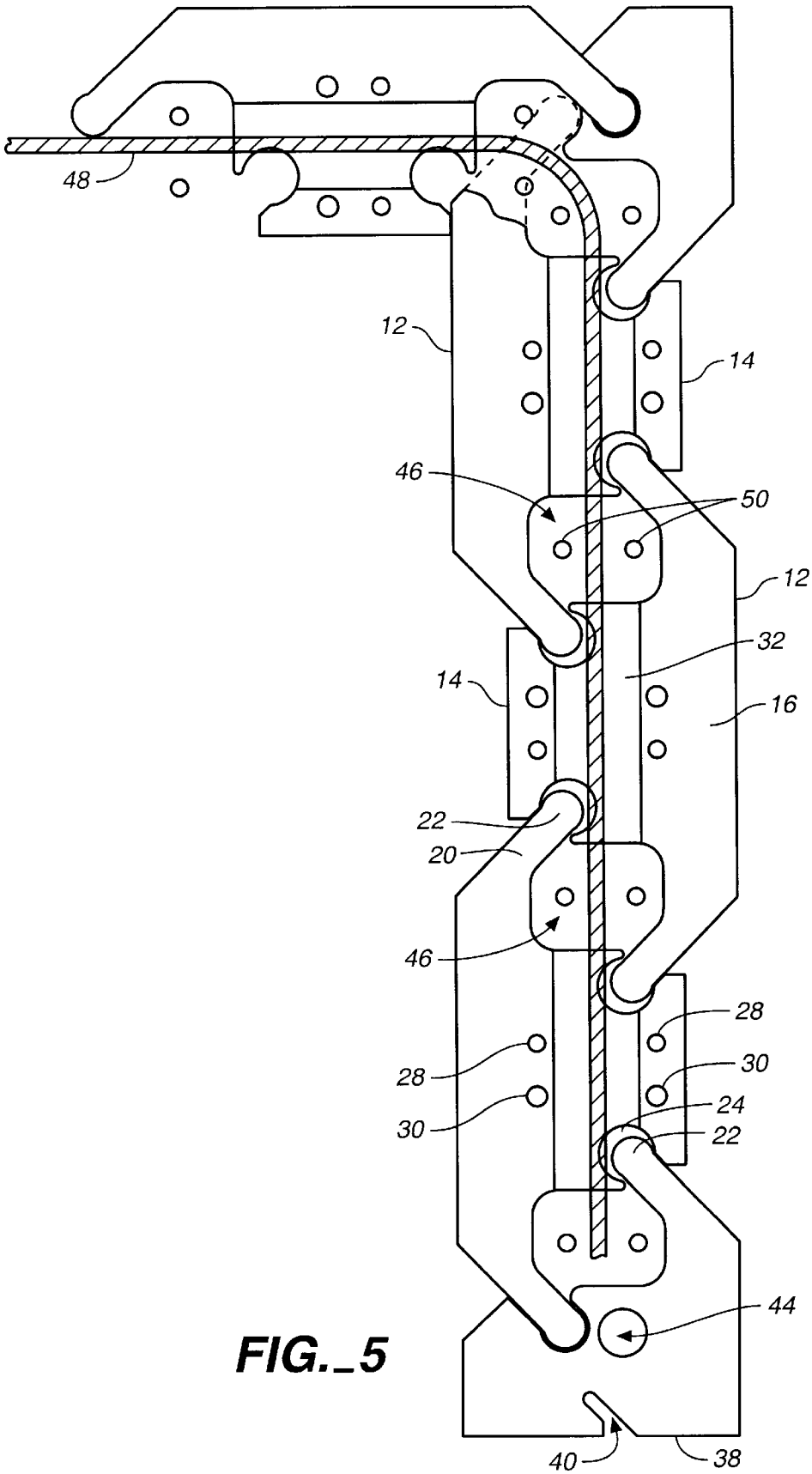
FIG. 5 is a plan view of a single level of a running bond course of the present invention utilizing the wall unit embodiment of FIG. I and the corner/end of FIG. 3, and further illustrating horizontal rebar layout.

The male posts 20 angle back from the front face 12 towards the rear face 14 at an approximately 133 degree angle and terminate in a enlarged cylindrical head 22 for interconnection with the female socket 24 of an adjoining block, in the fashion of an anatomical ball and socket joint. This interconnection assists in the stacked alignment of the block and provides increased lateral stability and resistance to shear forces. The rearwardly angled male posts 20 define partial apertures 26, such that when adjoining blocks are interconnected a complete aperture 46 is defined which extends vertically between the adjoined blocks for electrical and plumbing chase, and for placement of vertical reinforcement rebar and the introduction of mortar or cement, as is shown in FIG. 5. Additionally, the male posts and female sockets are adapted to be rotated slightly with respect to one another so as to allow construction of curved walls.

The top surface defines a shallow recess 32 located in approximately the middle of the block and running the length of the block at its middle portion essentially parallel to the front and rear faces. When mortar is poured into apertures 46 as described above, it also flows horizontally along the rebar layout and into recesses 32 between the upper surface 16 and the lower surface 18 of the block immediately above it.

FIG. 2 is a top view of an alternative embodiment of a dry-stackable cast block wall unit, illustrating a fluted, split face design with a roughly finished surface and semicircular concavities 36 in the front and rear faces. Any number of forms may be incorporated into the front and rear faces to give them an ornamental or decorative appearance in an assembled structure. In this second preferred embodiment, a tapered aperture 34 extends vertically through the block to define a center hole. This aperture may be expanded longitudinally according to the size of the block and serves a number of functions, including aiding in portability, weight reduction in molding, and a cavity for fill or reinforcement in certain applications.

FIG. 4 is a top view of a third preferred embodiment of a dry-stackable cast block wall unit, illustrating a fluted split face design especially well-suited for sound walls. The block is shown interconnected with adjoining blocks in a stacked bond layout with half height alternating starter course interlocks course to course. This figure also illustrates how the tapered aperture may be expanded in larger variations of the wall unit.

2. Corner/End Unit

FIG. 3 is a top view of a dry stackable cast block corner/end unit according to the present invention. This unit has an end face 38, one male post 20, one actually defined female socket 24, and a potential female socket defined by an interior cylindrical aperture 44 extending vertically through the block. When functioning as an end unit, the unit is left intact as depicted, and the open aperture female socket 24 interconnects with the male post of an adjoining wall unit block. When functioning as a corner unit, a portion of the block is removed by cutting along the cut lines 42 through the female socket 24 and the cut line channel 40 to the interiorly defined cylindrical aperture 44. When cut in this fashion, the cylindrical hole 44 becomes an open aperture of the same shape and size as a female socket and thus interconnects with the male post of an adjoining block positioned at a substantially right angle to the corner unit.

3. Wall Cap, End Cap, and Corner Cap Units

Figure 12:
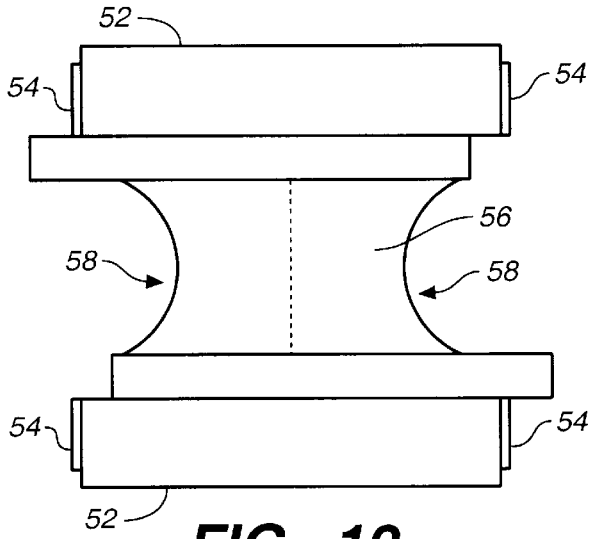
FIG. 12 is a top view of a dry-stackable cast block wall cap unit of the present invention.
Figure 13:
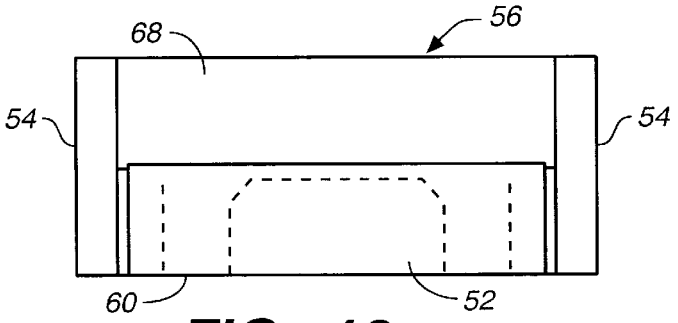
FIG. 13 is a side view of the wall cap unit of the present invention.
Figure 14:
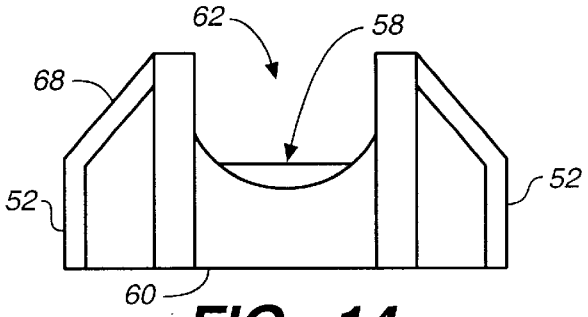
FIG. 14 an end view of the wall cap unit.

FIGS. 12, 13, and 14, show top, side, and end views, respectively, of a dry-stackable cast block wall cap unit of the present invention. This unit comprises two outer faces 52, two ends 54, a top bed face 56, two partial adjoining apertures 58 at opposite ends of the length of the unit, a bottom surface 60, and a recess extending into the top bed face and running along its entire length generally parallel to the outer faces. The upper portion 68 of the outer face 52 is beveled. The ends are of staggered length as defined by a short projection extending longitudinally at the side of the partial aperture on its respective end and a correspondingly short recess extending longitudinally into the block side at the opposite side of the partial aperture, so as to facilitate alignment and mating with adjoining wall caps or end caps and to increase stability.

Corner caps, shown only in layout (see FIG. 18), have the same structure as wall caps, but with a right angle introduced at the longitudinal midpoint.

Figure 15:
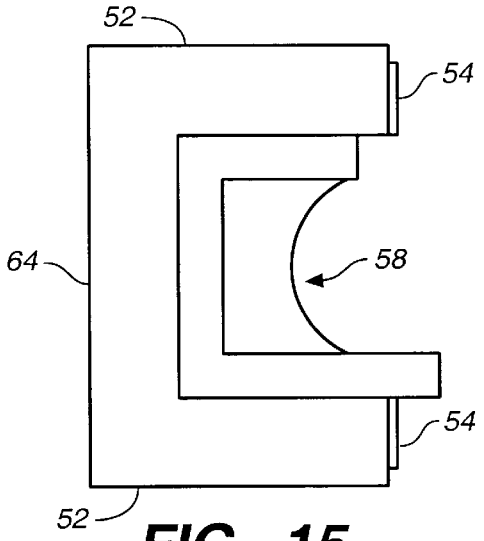
FIG. 15 is a top view of the end cap unit of the present invention.
Figure 16:
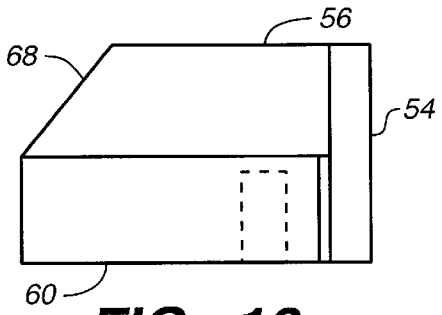
FIG. 16 is a side view of the end cap unit.
Figure 17:
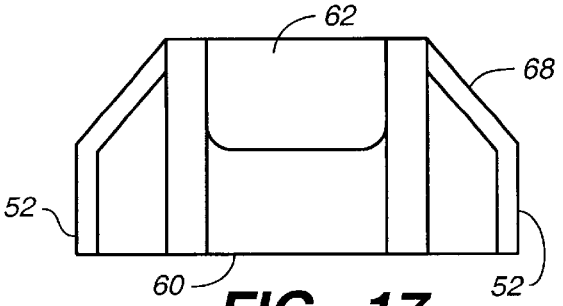
FIG. 17 is an end view of the end cap unit.

FIGS. 15, 16, and 17, are top, side, and end views, respectively, of the end cap unit of the present invention. This unit is essentially a truncated wall cap with two outer faces 52, one side 54, a single partial aperture 58, an end face 64 with a beveled upper portion 68, and a recess extending into the top bed face 56 which terminates short of the interior border of the end face.

5. Method of Constructing Dry-Stackable Masonry Unit Wall

The blocks of the present invention may be used in a variety of structural configurations. Preferably the masonry system is constructed upon a standard poured-in-place concrete footing with embedded vertical reinforcement, preferably provided at approximately 8 inch to 10 inch on center. A level footing and proper placement of reinforcement is achieved by using a 2×4 or edge at footing height and securing #4 or #5 rebars to each side of the 2×4. Rebar layout is simplified by beginning the 8 or 10 inch layout 6 inches in from any end or corner. With the footing finished level with the bottom edge of the 2×4, the footing will provide the necessary straight and level surface to begin laying the units. Curved walls may be laid using laminated 1×4's and the same rebar layout. Alternatively, the first course may be laid without poured footings.

For the standard running bond installation, FIG. 7, the lower course is laid by placing blocks adjacent to each other, either end to end or corner to corner. Each wall unit is laid with the upper surface 16 down, such that the upper surface recess 32 overlays the flat lower surface 18 of the block. This requires that the raised stops 28 be chipped from the first course only; subsequent courses are alternated such that the raised stops 28 fit into the through holes 30 of the preceding course.

For a stacked bond installation, FIG. 6, the first course is laid with the upper surface 16 down and the succeeding courses are alternately inverted.

Figure 8:
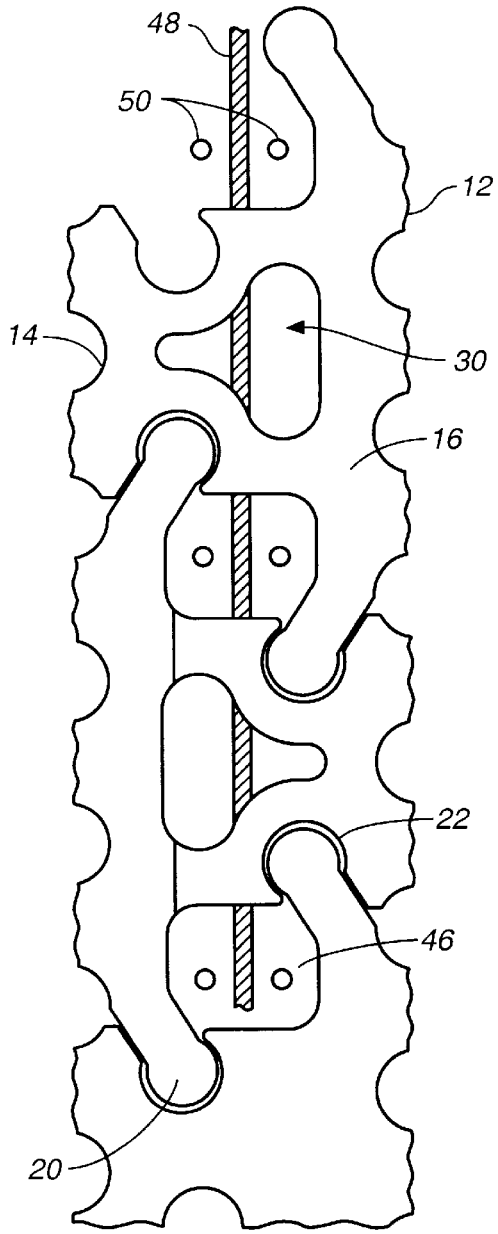
FIG. 8 is a plan view of a stacked bond alternating half-height starter layout using fluted/split face design blocks as illustrated in FIG. 2, and showing rebar layout.
Figure 9:
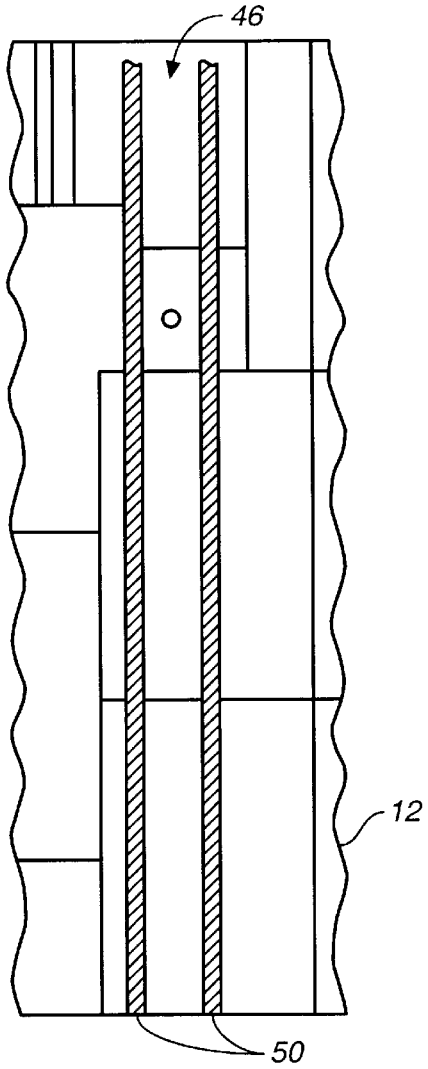
FIG. 9 is an end view of the layout of FIG. 8.
Figure 10:
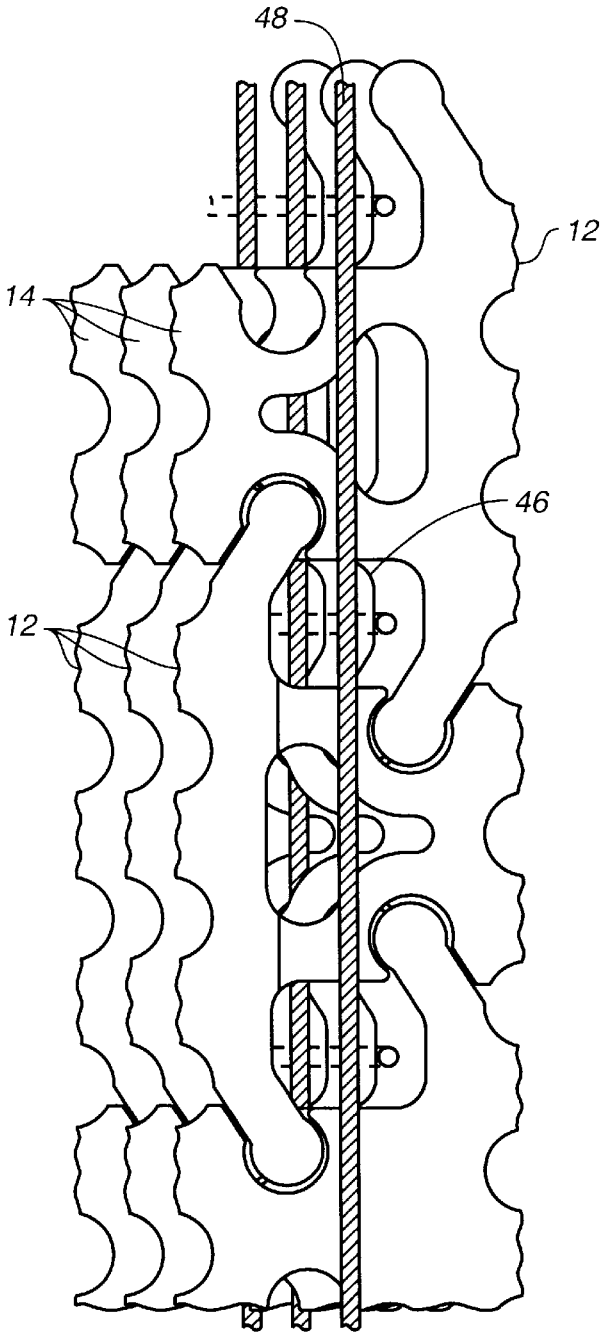
FIG. 10 is a plan view of a stepped layout, showing rebar layout.
Figure 11:
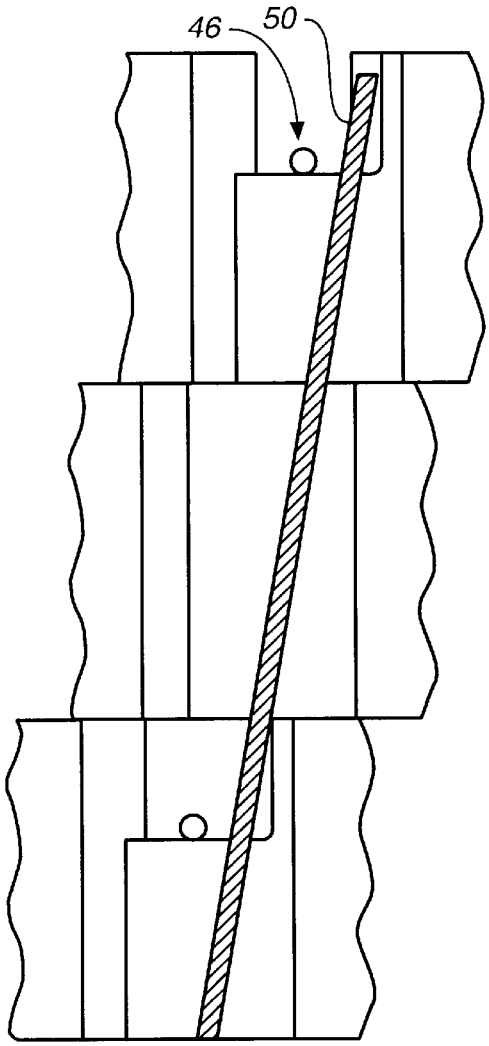
FIG. 11 is an end view of the layout of FIG. 10.

In the standard running bond installation, alternating layout, FIGS. 5 and 8, it can be seen that for a given course adjacent blocks interlock via male posts 20 and female sockets 24, and thereby form a series of fillable vertical apertures or cavities 46 and horizontal apertures or cavities 32 for the placement of horizontal rebar 48 and vertical rebar 50 and the introduction of mortar or concrete. The same cavities and reinforcement schedules apply to a stacked bond layout with alternating half-height starter, FIGS. 8–9, and stepped layouts, FIGS. 10–11. The running bond installation comprises alternating front and rear faces on a given course, thus creating alternating recesses located at each rear face 14. This produces an attractive wall finish which is an unattractive target for defacement by graffiti vandals.

Figures 18, 19, 20:
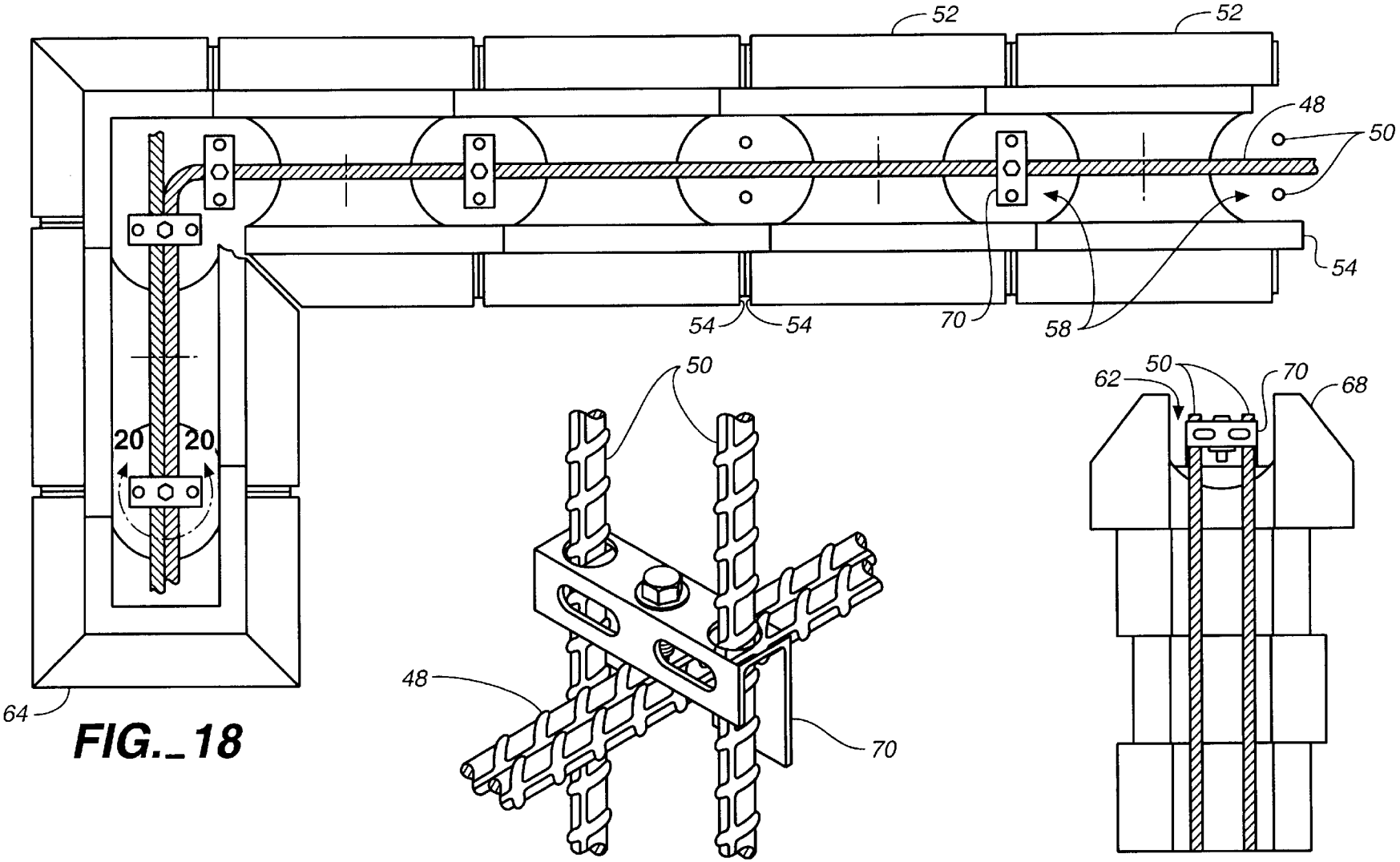
FIG. 18 is a plan view of a wall cap and end cap layout, showing rebar layout and tension-compression clamp placement.
FIG. 19 is an end view of a running bond layout showing rebar reinforcement and tension-compression clamp placement in the superior cavity of a wall cap as shown in FIG. 14.
FIG. 20 is an enlarged view of a tension-compression clamp of the kind that may be used to secure the superior end of vertical rebar reinforcement in a wall assembly of the present invention.

FIG. 18 is a plan view of the wall cap, corner cap, and end cap layout of the present invention, showing horizontal rebar layout 48, vertical rebar placement 50, and tension-compression clamp placement 70. FIG. 19 is an end view of a running bond layout showing vertical rebar reinforcement 50 and tension-compression clamp placement 70 in the superior cavity 62 of a wall cap as shown in FIGS. 12–14. FIG. 20 is an enlarged view of a tension-compression clamp 70 of the kind that may be used to secure the superior end of vertical rebar reinforcement 50 in a wall assembly of the present invention.

As can be seen, the cavities created by adjoining partial apertures 58 complement and continue the same cavities 46 formed by adjoining units laid in lower courses. Horizontal rebar is laid over the superior surface of the top bed face to complete the last course, and a tension-compression clamp 70 is placed over the superior ends of vertical rebar 50 and secured at the conjunction with the horizontal rebar. See FIG. 19. Mortar or concrete may be poured into the cavities defined by adjoining units to flow through the cavities and form a continuous joint around the blocks while leaving the front and rear faces exposed and virtually free of excess slurry.

Due to the post and socket fit, spacing between units is adjustable within limits. Thus, walls constructed of the blocks of the present invention are adaptable to the constraints of terrain. In high walls, areas with a hump in the footing may have units spaced as closely together as possible, while areas with dips may have units pulled apart as far as possible. This will allow the top of the wall to lengthen or shorten as necessary, to a maximum of one-half inch per unit.

Horizontal reinforcement 48 may be installed on any given course of running bond. A ¾ inch dobbie is placed in the center of the wall unit at approximately 30 inch intervals and tied to the rebar. The correct front-to-back placement will be automatically achieved by the posts of the units in the next course. Additionally, proper placement of the vertical rebar 50 is secured by the use of a rebar spacer tie which also prevents up lift while being vibrated with a mechanical vibrator. While a maximum lift of four feet is standard, a lift of two feet will not require mechanical vibration and can be consolidated by rodding with a rebar dowel.

End units require no special attention. The post 20 and socket 24 of this unit are preferably slightly larger and smaller, respectively, than those of the wall unit to assist in proper alignment and to prevent movement during mechanical vibrating. Corner units require that one post be cut or broken off from a wall unit and two cuts along prescored cut lines 42 of the end unit. The corner is then laid in the typical alternating pattern for running bonds or stacked in one direction only. Horizontal reinforcement is carried through the corner on any given course.

The masonry system of the present invention is designed to meet the specifications required for a coarse grout mix, which may be pumped in place and mechanically vibrated or poured in place and rodded by hand with a rebar dowel. Clean up of excess slurry from between the units with a water hose, nozzle and small trowel should begin as soon as grouting is completed.

While the post and socket design of the present invention allows for considerable flexibility in construction tolerances and techniques, they are equalled by the variable possibilities for architectural design with only a few finishes or colors. For example, quoins may be highlighted at corners and ends by simply changing the colors. The apparent depth of the recess may be dramatized or negated with a similar change of color.

On large walls of any height or length, a half-height block unit may be employed for more cost-effective construction and a more architecturally pleasing finish. For smaller scale projects a proportionately smaller version may be desirable. While of the same design, it would have a rebar layout of approximately 8 inch on center for added structural integrity, but would also have the appearance of delicately interwoven brick work.

The masonry system of the present invention is inherently flexible and versatile with a minimum of bearing cross section. It may be employed for either free standing or retaining walls. It may be either straight or curved vertical or stepped, and laid out in running or stacked bonds. Its unique design minimizes manufacturer materials, on-site labor, and skill requirements for construction. It is self-aligning, eliminates vertical gaps, follows minor footing contours, provides bond beam on any course, improves sound attenuation, allows continuous reinforcement, improves design, and discourages graffiti.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A cast dry-stackable masonry block for constructing an interconnected wall of a plurality of said blocks, comprising:

a front face;

a rear face;

a first side;

a second side;

a first male post projecting outwardly and rearwardly from said first side, said first male post terminating in a generally cylindrical enlargement and positioned so as to mate with an aperture of an adjacently positioned block;

a second male post projecting outwardly and rearwardly from said second side, said second male post terminating in a generally cylindrical enlargement and positioned so as to mate with an aperture of an adjacently positioned block;

a first female socket integrally formed as a radial aperture in said first side and positioned for receivably mating with an adjacently positioned block, the aperture of said first female socket describing an arc of at least 180 degrees;

a second female socket integrally formed as a radial aperture in said second side and positioned for receivably mating with an adjacently positioned block, the aperture of said second female socket describing an arc of at least 180 degrees;

an upper face; and a lower face.

2. The block of claim 1 wherein each of said first and second male posts and first and second female sockets have relative sizes adapted to permit rotation of the male posts and the female sockets within which it is mated such that a curved wall may be constructed from a plurality of such blocks.

3. The block of claim 1 wherein said upper face has at least one small diameter circular hole extending vertically through the block, and at least one small diameter cylindrical raised projection, such that when stacked with other of said blocks said hole will mate with the raised projection of a block in reversed position immediately above and/or immediately below said block.

4. The block of claim 1 wherein said upper face defines a shallow recess located in approximately the middle of the block and running the length of the block at its middle portion essentially parallel to the front and rear faces, such that said shallow recess is of sufficient depth to accommodate #4 or #5 rebar laid horizontally across said recess.

5. The block of claim 1 wherein said first and second male posts project rearwardly from the front face towards the rear face at an approximately 133 degree angle.

6. The block of claim 1 wherein said front and rear faces are smoothly finished concrete.

7. The block of claim 1 wherein said front and rear faces are fluted, split faces with a rough concrete finish.

8. The block of claim 7 wherein said block further includes a tapered aperture extending vertically through the middle of said block to define a center hole.

* * * * *